US009334072B2

(12) United States Patent
Williams et al.

(10) Patent No.: US 9,334,072 B2
(45) Date of Patent: May 10, 2016

(54) LIQUID DISPENSING SYSTEM AND METHOD FOR USE IN THE FORMATION OF A TOBACCO POUCH PRODUCT

(75) Inventors: Dwight D. Williams, Powhatan, VA (US); Cary Longest, Midlothian, VA (US)

(73) Assignee: PHILIP MORRIS USA INC., Richmond, VA (US)

( * ) Notice: Subject to any disclaimer, the term of this patent is extended or adjusted under 35 U.S.C. 154(b) by 1122 days.

(21) Appl. No.: 13/073,539

(22) Filed: Mar. 28, 2011

(65) Prior Publication Data

US 2012/0017542 A1 Jan. 26, 2012

Related U.S. Application Data

(60) Provisional application No. 61/318,227, filed on Mar. 26, 2010.

(51) Int. Cl.

| | |
|---|---|
| ***B65B 9/20*** | (2012.01) |
| ***B65B 29/00*** | (2006.01) |
| ***B65B 61/00*** | (2006.01) |
| ***A24B 15/30*** | (2006.01) |
| ***B65B 9/207*** | (2012.01) |

(52) U.S. Cl.

CPC ..... *B65B 9/207* (2013.01); *A24B 15/301* (2013.01); *B65B 29/00* (2013.01); *B65B 61/00* (2013.01); *B65B 2220/20* (2013.01)

(58) Field of Classification Search

CPC ..... B65B 9/207; B65B 9/22; B65B 9/2056; B65B 9/2021; B65B 29/00; B65B 61/00; A24B 15/301; A24C 5/608

USPC ..... 53/551, 131.1, 451, 411; 131/284; 118/264; 427/429

See application file for complete search history.

(56) References Cited

U.S. PATENT DOCUMENTS

| | | | | |
|---|---|---|---|---|
| 3,778,961 | A * | 12/1973 | Lesher | 53/451 |
| 3,789,569 | A * | 2/1974 | Egger | 53/451 |
| 4,068,614 | A * | 1/1978 | Kopachkov | 118/674 |

(Continued)

FOREIGN PATENT DOCUMENTS

| | | | |
|---|---|---|---|
| DE | 19719000 | A1 | 11/1998 |
| GB | 805983 | A | 12/1958 |

(Continued)

OTHER PUBLICATIONS

International Search Report and Written Opinion of PCT/IB2011/000978 dated Oct. 11, 2011, 11 pages.

*Primary Examiner* — Stephen D Gerrity

(74) *Attorney, Agent, or Firm* — Roberts Mlotkowski Safran & Cole, P.C.

(57) ABSTRACT

A liquid dispenser system for use with an apparatus for forming and filling pouched products, the system comprising a first fluid dispenser shoe, the first fluid dispenser shoe comprising an inlet bore for placing in fluid communication with a source of liquid to be dispensed; at least one liquid dispensing manifold in fluid communication with the inlet bore; and a plurality of exit orifices positioned along the at least one liquid dispensing manifold for dispensing the liquid on an outer surface of the pouched product, wherein the first fluid dispenser shoe is positioned downstream of the apparatus for forming and filling pouched products and adjacent a stream of pouched products as they exit the apparatus.

31 Claims, 4 Drawing Sheets

(56) References Cited

U.S. PATENT DOCUMENTS

| | | | | |
|---|---|---|---|---|
| 4,081,943 | A | 4/1978 | Leasure et al. | |
| 4,386,576 | A * | 6/1983 | Johnson | 118/211 |
| 4,537,650 | A * | 8/1985 | Coons, Jr. | 156/384 |
| 4,601,918 | A * | 7/1986 | Zaman et al. | 427/429 |
| 4,604,300 | A * | 8/1986 | Keys et al. | 427/429 |
| 4,703,765 | A | 11/1987 | Paules et al. | |
| 5,167,244 | A * | 12/1992 | Kjerstad | A24B 15/16 131/352 |
| 5,656,315 | A * | 8/1997 | Tucker et al. | 53/431 |
| 5,853,481 | A * | 12/1998 | Williamitis et al. | 118/264 |
| 6,488,772 | B2 * | 12/2002 | Falck et al. | 118/264 |
| 6,506,021 | B1 | 1/2003 | Wilson et al. | |
| 2005/0287303 | A1 * | 12/2005 | Gorra | 427/429 |
| 2007/0012328 | A1 | 1/2007 | Winterson et al. | |
| 2007/0102014 | A1 * | 5/2007 | Hafker et al. | 53/111 R |
| 2010/0300464 | A1 * | 12/2010 | Gee | A24B 15/16 131/275 |

FOREIGN PATENT DOCUMENTS

| | | | |
|---|---|---|---|
| RU | 2303138 | C2 | 5/2005 |
| WO | 00/48907 | A1 | 8/2000 |
| WO | 03/089302 | A1 | 10/2003 |
| WO | 2004/009445 | A1 | 1/2004 |
| WO | 2004/052335 | A1 | 6/2004 |

* cited by examiner

LIQUID DISPENSING SYSTEM AND METHOD FOR USE IN THE FORMATION OF A TOBACCO POUCH PRODUCT

This application claims the priority benefit of U.S. Provisional Application No. 61/318,227, filed Mar. 26, 2010. The entire contents of which are hereby incorporated by reference.

FIELD

The present invention generally relates to pouched products and methods and systems for their formation. More particularly, the present invention relates to an apparatus, system and method for applying a flavorant or other component to a pouched product.

ENVIRONMENT

Pouched tobacco products offer an individual portion of tobacco that is to be placed under the upper lip. During production of pouched products, problems may arise when flavorants or other components are sought to be included. As may be appreciated, when a liquid flavorant or other material is added directly to the tobacco, the flow characteristics of the tobacco used to fill the individual pouches may be altered significantly, leading to production problems and downtime. As such, it would be desirable to provide an apparatus, system and method for applying a flavorant or other component that avoids such problems.

SUMMARY

Provided is a liquid dispenser system for use with an apparatus for forming and filling pouched products. The system includes a first fluid dispenser shoe, the first fluid dispenser shoe comprising an inlet bore for placing in fluid communication with a source of liquid to be dispensed; at least one liquid dispensing manifold in fluid communication with the inlet bore; and a plurality of exit orifices positioned along the at least one liquid dispensing manifold for dispensing the liquid on an outer surface of the pouched product, wherein the first fluid dispenser shoe is positioned downstream of the apparatus for forming and filling pouched products and adjacent a stream of pouched products as they exit the apparatus.

Also provided is a system for making a pouched product. The system comprises means for supplying a web material for forming a pouch; an apparatus for forming and filling the pouched product, the apparatus including an elongated tubular member, the elongated tubular member having a first end, a second end and an outer surface, the outer surface of the elongated tubular member providing a surface for forming the pouched product from the supply of web material; a forming shoulder, the forming shoulder receiving the web from the supply of web material and folding the web about the apparatus to form the pouch having longitudinal edge portions; a heated knurled disc for sealing the longitudinal edge portions of the web to form a seam as the web is drawn along the apparatus; a liquid dispenser system comprising a first fluid dispenser shoe, the first fluid dispenser shoe comprising an inlet bore for placing in fluid communication with a source of liquid to be dispensed; at least one liquid dispensing manifold in fluid communication with the inlet bore; and a plurality of exit orifices positioned along the at least one liquid dispensing manifold for dispensing the liquid on an outer surface of the pouched product, wherein the first fluid dispenser shoe is positioned downstream of the apparatus for forming and filling pouched products and adjacent a stream of pouched products as they exit the apparatus.

Also provided is a method of forming a pouched flavored tobacco product. The method includes the steps of providing a web for use in forming the pouched flavored tobacco product; forming and filling a pouched flavored tobacco product using an apparatus having an elongated tubular member, the elongated tubular member having a first end, a second end and an outer surface, the outer surface of the elongated tubular member providing a surface for forming the pouched flavored tobacco product thereabout; and providing a liquid comprising one or more flavorants to a liquid dispenser system comprising a first fluid dispenser shoe, the first fluid dispenser shoe comprising an inlet bore for placing in fluid communication with a source of liquid to be dispensed; at least one liquid dispensing manifold in fluid communication with the inlet bore; and a plurality of exit orifices positioned along the at least one liquid dispensing manifold for dispensing the liquid on an outer surface of the pouched product, wherein the first fluid dispenser shoe is positioned downstream of the apparatus and adjacent a stream of pouched products as they exit the apparatus.

Also provided is method of coating an object with a fluid, comprising communicating a fluid with an array of exit orifices while drawing the object along a path adjacent the array of exit orifices, wherein the object cooperates with the array of exit orifices to draw the fluid therefrom and onto the object and at least partially coat the object.

In one form, the object cooperates with the array of exit orifices, drawing fluid therefrom through capillary or wicking action object.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
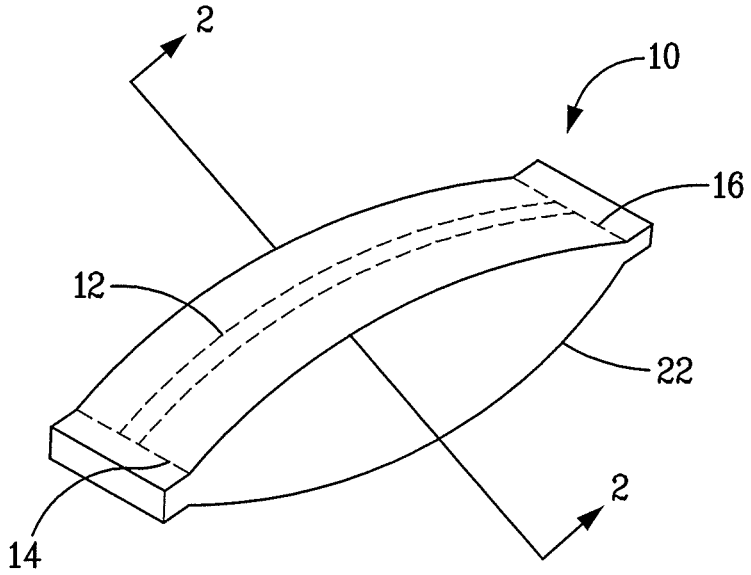
FIG. 1 illustrates one form of a pouched tobacco product, produced in accordance herewith.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1-5, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "'having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Figure 2:
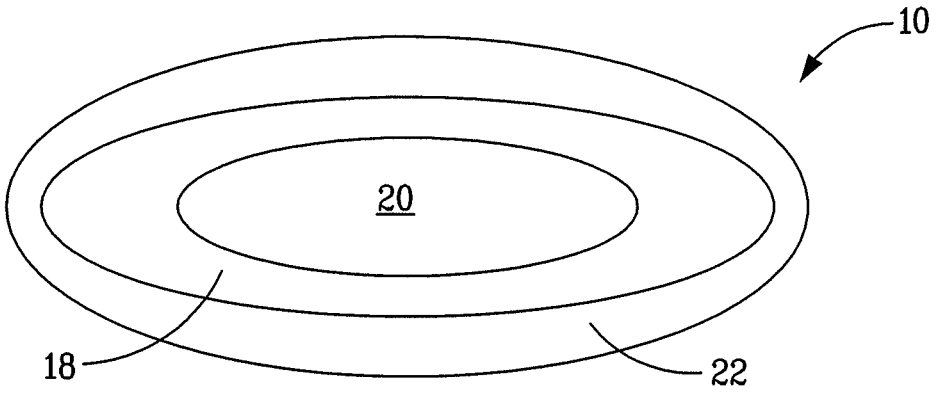
FIG. 2 illustrates a cross-sectional view of one form of a pouched tobacco product, including an optional liner, produced in accordance herewith.

FIG. 1 illustrates a pouched tobacco product 10, produced in accordance herewith. As shown, the pouched tobacco product 10 has a longitudinal seam 12 and transverse seams 14 and 16, as will be described in further detail below. With reference to FIG. 2, a pouched tobacco product 10 is shown with optional liner 18 disposed between a portion of tobacco material 20 and a web 22. The optional liner 18 reduces the tendency of the tobacco material 20 to discolor or stain the web 22. The optional liner 18 reduces staining of the web 22 by reducing the opportunity for moisture from the tobacco material 20 or its additives to reach the web 22 prior to use. It also allows the moisture content and other constituents of the tobacco material 20 to be maintained in its original, fresh, condition until use.

Figure 3:
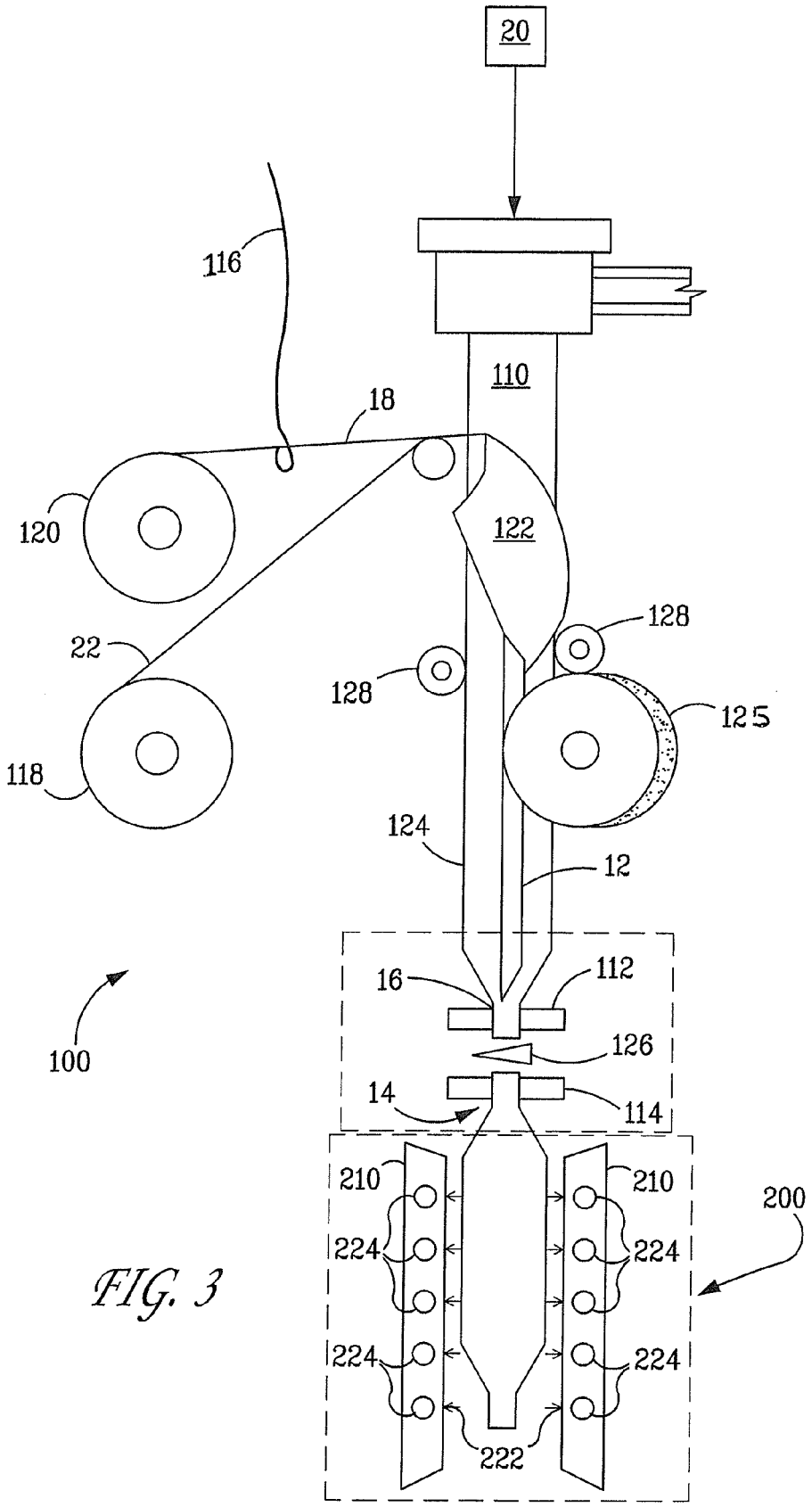
FIG. 3 illustrates exemplary equipment for formation of pouched tobacco products, in accordance herewith.
Figure 4:
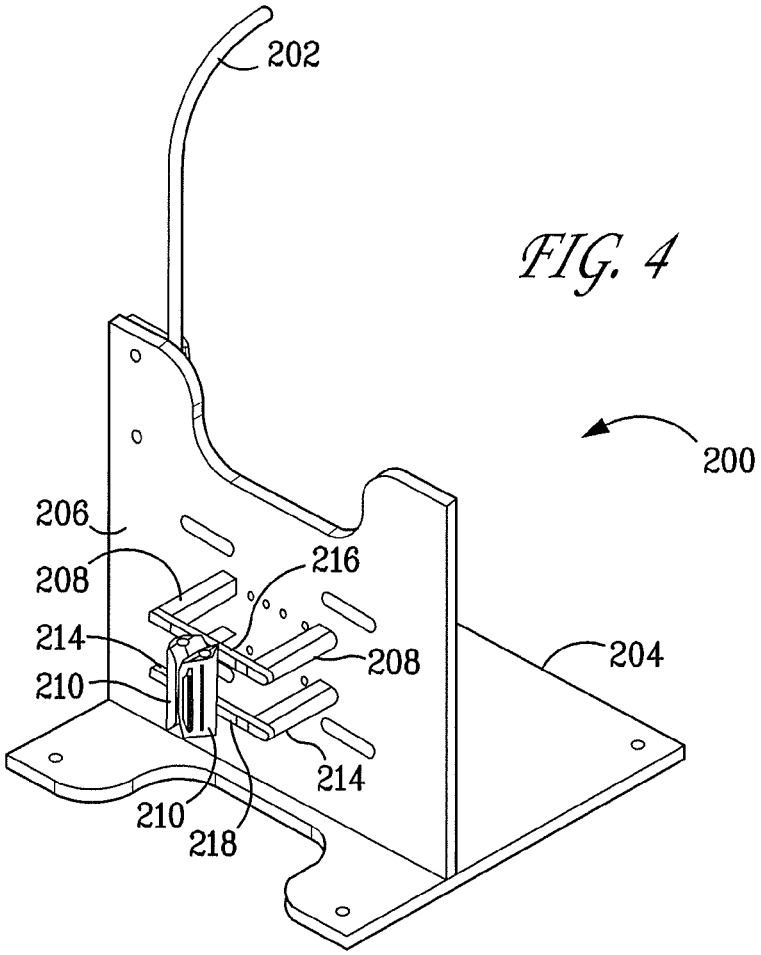
FIG. 4 illustrates a liquid dispenser system for use with an apparatus for forming and filling pouched products, in accordance herewith.
Figure 5:
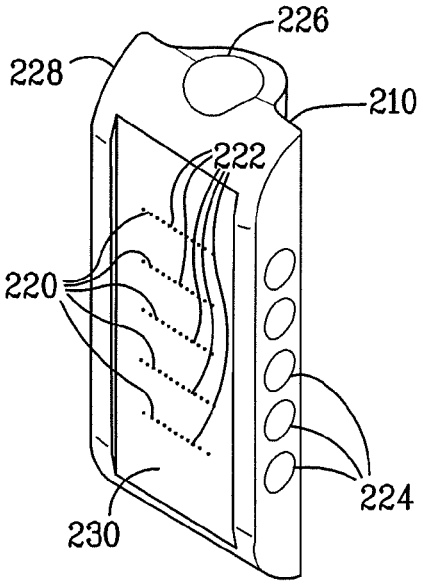
FIG. 5 illustrates a fluid dispenser shoe for use with a liquid dispenser system, in accordance herewith.

Any suitable equipment may be used to produce the pouched tobacco product 10, so long as it can accommodate the liquid dispenser system and apparatus for use in the formation and filling of a pouched product disclosed herein and depicted in FIGS. 3-5. For example, a poucher machine sourced from Merz Verpackungsmaschinen GmbH, Lich, Germany, may be employed.

With reference to FIG. 3, a system 100 for use in producing pouched tobacco product is shown schematically. System 100 includes an apparatus 110 for use in the formation and filling of a pouched product, as disclosed herein. In operation, ribbons of web 22 and, optionally, liner film 18 from which disposable backing 116 has been removed are both drawn from separate bobbins 120, 118, respectively, toward a forming shoulder 122, which folds the web 22 and optional liner film 18 about the apparatus 110, forming a pouch precursor 124.

Figure 6:
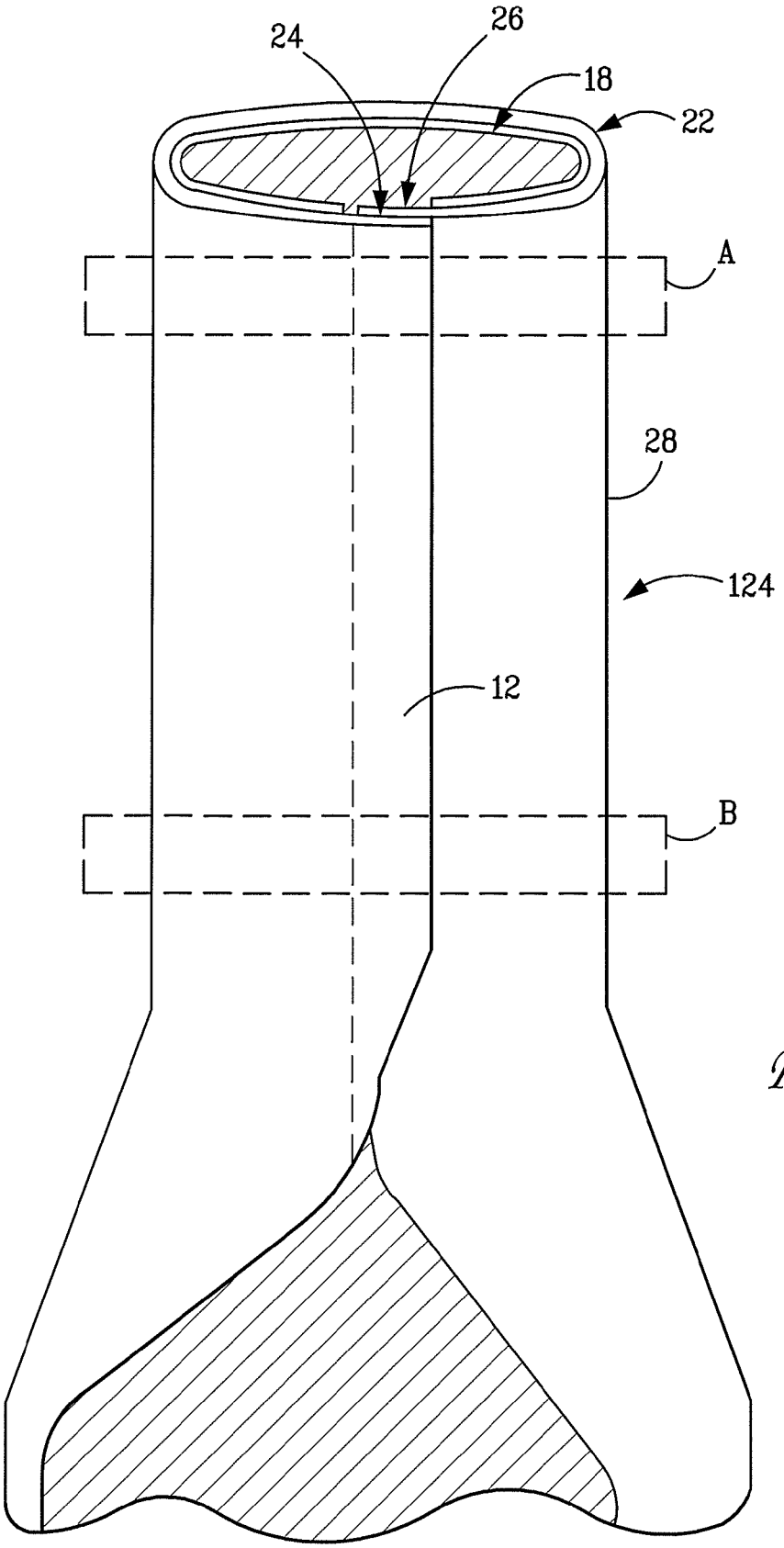
FIG. 6 is a perspective view of pouch material shown in a condition of being rolled into a tubular formation.

Referring also to FIG. 6, edge portions 24, 26 are brought into overlapping relation and the tubular formation 28 is established. FIG. 6 illustrates the case employing an optional liner 18, where web 22 and optional liner 18 are folded into a tubular formation 28 with the optional liner 18 on the inside. In so doing, the longitudinal edge portions 24, 26 are brought into an overlapping, web-to-web relation and sealed to form the longitudinal seam 12, which is preferably about 3 mm wide in the exemplary form. As shown, the longitudinal seam 12 is essentially free of liner material so that the seal is steadfast. Such arrangement also minimizes heating of liner material during sealing operations along the longitudinal seam 12 so that impact on taste of the product during formation of the longitudinal seam 12 is minimized. A packet of pouched tobacco 10 is achieved by introduction of tobacco 20 into the tubular form 28, and also sealing and cutting the tubular formation 28 at locations A and B, as described in further detail below Referring also to FIG. 3, a heated knurled disc 125 then seals the overlapping longitudinal edge portions 24, 26 of the web 22 by pressing and heating the seam as the web 22 is drawn along apparatus 110.

Drive belts or drive wheels 128 located below forming shoulder 122 continuously pull web 22 through forming shoulder 122 and beyond. An upper pair of opposing heat-sealing elements 112, and a lower pair of heat-sealing elements 114 cooperate with a knife 126 to repetitively seal and sever. Discrete charges of tobacco 20 are fed through apparatus 110 in timing with operation of sealing elements 112, 114. The transverse sealing elements 112, 114 and knife 126 arrangement follow a motion cycle where sealing elements 112, 114 close together, whereupon tobacco 20 is fed into the apparatus 110. They then move down together in opposing relation with each other to a final lowered position whereupon the knife 126 operates to sever the web 22. The sealing elements apparatus 110 then retract and return to original starting position further up apparatus 110.

After insertion of a portion of tobacco 20 into the tubular form 28, sealing and severing operations form seams 14, 16 at a location corresponding to the area A shown in FIG. 6 to close a filled pouch 10 and preferably to form the bottom seal of the next pouch to be filled. After severing in the area of the seams 14, 16, a filled pouch 10 is closed at its upper transverse seam 14, which may be, for example, about 3.5 mm wide. Severing in the area of the seals 14, 16 thus separates the top transverse seam 14 of a filled pouch 10 from the bottom seam 16 of the next pouch to be filled.

Alternatively, when an optional liner 18 is employed, a laminate of web and film liner may be drawn from a single bobbin to the forming shoulder 122 of the previously described equipment. Such form and the method of making are described in detail in U.S. Publication No. 2007/0012328, the contents of which are incorporated in their entirety for all that it discloses.

When tobacco is the product to be pouched, the inclusion of a variety of other components, including flavorants, is often desired. It is known to mix such components with the tobacco prior to forming the pouched product. However, due to the nature of many of the flavorants, it would be advantageous to add the flavorants separately to avoid issues with regard to the flowability of the tobacco.

Referring now to FIGS. 3-5, one form of a liquid dispenser system for use with an apparatus for forming and filling pouched products 200 will now be described. Liquid dispenser system 200 includes a first fluid dispenser shoe 210, first fluid dispenser shoe 210 including an inlet bore 226 for placing in fluid communication with a source of liquid (not shown) to be dispensed. Inlet bore 226 may be connected to the source of liquid to be dispensed by pipe 202, as shown in FIG. 4.

First fluid dispenser shoe 210 also includes at least one liquid dispensing manifold 224 in fluid communication with inlet bore 226. As shown, each liquid dispensing manifold 224 includes a plurality of exit orifices 222 positioned along the at least one liquid dispensing manifold 224. In one form, plurality of exit orifices 222 may be positioned longitudinally along liquid dispensing manifold 224 so as to form a line 220 of exit orifices 222. In one form, a plurality of liquid dispensing manifolds 224 are provided, each aligned substantially parallel with respect to one another.

In one form, in order to flow sufficient liquid flavorant, each liquid dispensing manifold 224 may include at least four exit orifices each having a diameter of about 0.2 mm. In another form, each liquid dispensing manifold 224 includes at least six exit orifices each having a diameter of about 0.2 mm. In yet another form, each liquid dispensing manifold 224 includes at least eight exit orifices each having a diameter of about 0.2 mm. The exit orifices are sized so that they effect a capillary or wicking action as material is drawn across them.

Referring again to FIG. 3, to dispense the liquid on an outer surface of the pouched product 10, the first fluid dispenser shoe 210 may be positioned downstream of the apparatus for forming and filling pouched products 110 and adjacent a stream of pouched products 10 as they exit the apparatus 110. In another preferred form, the knife 126 is relocated to a fixed position spaced vertically down from the sealing elements 112 and 114, so that the latter are allowed to produce a sting of pouches, except for not yet being severed from one another. In addition, a first fluid dispenser shoe 210 may be positioned upstream of the relocated knife 126, so that the string of pouched products are coated prior to severing.

Referring to FIGS. 3-5, the first fluid dispenser shoe 210 may further include a block 228 for forming the at least one liquid dispensing manifold 224 within. While block 228 may be of any suitable size or shape, in one form, block 228 is rectangularly configured. Optionally, block 228 may include track member 230. As shown in FIG. 3, the at least one liquid dispensing manifold 224 may be positioned within block 228 so as to be substantially perpendicular to the stream of pouched products 10 exiting the apparatus 110. In one form, wherein a solid block 228 is used, each liquid dispensing manifold 224 is formed by boring transversly through block 228 and capping of the ends of the bore using screws or plugs. Likewise, inlet bore 226 may be at least partially bored longitudinally so as to communicate with each liquid dispensing manifold 224. Again, the inlet bore 226 may be capped at its lower end using screws or plugs.

In one form, as shown in FIGS. 3 and 4, liquid dispensing system 200 includes a second fluid dispenser shoe 210, second fluid dispenser shoe 210 positioned substantially parallel to first fluid dispenser shoe 210 and spaced apart therefrom so as to permit the stream of pouched products 10 to pass therebetween and receive the dispensed liquid on at least two sides thereof.

Referring now to FIG. 4, liquid dispensing system 200 may also include a bracket member 206 for mounting first and second fluid dispenser shoes 210 thereto. Bracket member 206 may also include a plate 204 for fixedly locating liquid dispensing system 200. As shown, second fluid dispenser shoe 210 is positioned substantially parallel to first fluid dispenser shoe 210 in a spaced apart relationship so as to permit a stream of pouched products 10 to pass therebetween and receive the dispensed liquid on at least two sides thereof (see also FIG. 3).

First and second fluid dispenser shoes 210 may be set-off from bracket member 206 by a pair of upper locating posts 208 and a pair of lower locating posts 214. An upper mounting bar 216 bridges upper locating posts 208, providing a mounting surface for first and second fluid dispenser shoes 210. Likewise, a lower mounting bar 218 bridges lower locating posts 214, also providing a mounting surface for first and second fluid dispenser shoes 210.

Again, in a more preferred form, each fluid dispenser shoe 210 is positioned upstream of knife 126 of the apparatus for forming and filling pouched products 110, so that the pouched products are coated prior to severing. When two shoes 210 are employed the pair of track members 230 serve to form a track through which the unsevered pouched products may pass. Advantageously, through proper spacing of the fluid dispenser shoes 210, the unsevered pouched products will cooperate with the array of exit orifices, drawing fluid therefrom through capillary or wicking action.

As indicated, the apparatus for use in the formation and filling of a pouched product 110, disclosed herein, addresses these issues. In operation, a liquid comprising one or more flavorants and aromas may be fed to liquid dispensing system 200 and metered through the plurality of exit orifices 222, thereby providing at least a partial coating of the one or more flavorants on an outer surface of the pouched product 10.

Suitable flavorants and aromas include, but are not limited to, any natural or synthetic flavor or aroma, such as tobacco, smoke, menthol, mint (such as peppermint and spearmint), chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, and ginger oil. Other suitable flavors and aromas may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Exemplary additional natural and artificial flavorants include, but are not limited to, peppermint, spearmint, wintergreen, menthol, cinnamon, chocolate, vanillin, licorice, clove, anise, sandalwood, geranium, rose oil, vanilla, lemon oil, cassia, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, orange oil, coriander oil, borneol, fruit extract, and the like. Particularly preferred additional flavor and aroma agents are essential oils and/or essences of coffee, tea, cacao, and mint.

The liquid may optionally comprise both natural and artificial sweeteners. Preferred sweeteners include water soluble sweeteners such as monosaccharides, disaccharides and polysaccharides (e.g., xylose, ribose, sucrose, maltose, fructose, glucose, maltose, and mannose). In addition, or in the alternative to sweeteners, the liquid may comprise souring agents such as acetic acid, adipic acid, citric acid, lactic acid, malic acid, succinic acid, tartaric acid, and mixtures thereof.

In one form, the liquid has a viscosity approximately equal to that of water.

As may be appreciated, a wide variety of materials are useful in the fabrication of the liquid dispensing system 200 for use with the apparatus for forming and filling a pouched product 10. In one form, each liquid dispensing manifold 224 is formed of stainless steel. In another form, the stainless steel is 316 stainless steel.

Referring now to FIGS. 3 and 6, with regard to supplying tobacco to apparatus 110, metered portions of tobacco 20 may be blown via air into apparatus 110, after the upper and lower sealing elements 112, 114 have been closed upon the tubular formation 28. Optionally, the longitudinal seam 12 is made narrower then the width of the overlapping, longitudinal edge portions 24, 26 along the tubular formation 28. In so doing, web material remains in an unsealed condition along the seam 12, and as such is air permeable. The air permeable web portions along the longitudinal seam 12 allow air to pass through the permeable web and thus avoid blowback of tobacco during tobacco feeding operations into apparatus 110.

In effect, the overlapping material along the seams 12 and/or 16 is optionally greater than the width of the sealed regions establishing the seams 12 and/or 16 so that along those seams some material remains in an unsealed condition and is therefore air-permeable. Optionally, one or more of the seams 12, 14 and 16 include at least one air permeable portion.

The air permeable portions along the seams 12 and/or 16 allow air to pass through the porous web and thus avoid blowback of tobacco during tobacco feeding operations.

While a system for manufacturing pouched tobacco products has been described above, other systems can be used such as KDF machinery available from Hauni Manufacturing, Hamburg, Germany, whereby instead of using a forming shoulder 122, as described above, a garniture can be used to fold a continuous strip of web material into a tubular form which is heat sealed and filled with tobacco to form individual tobacco pouched products 10. Yet another system that can be used is one available from MediSeal GmbH of Flurstrasse 65, 33758 Schloss-Holte, Germany. See also U.S. Pat. No. 4,703,765, the disclosure of which is hereby incorporated by reference for details of other machinery that can be adapted to manufacture pouches as described herein.

In another form, provided is a method of forming a pouched flavored tobacco product. The method includes the steps of providing a web for use in forming the pouched flavored tobacco product; forming and filling a pouched flavored tobacco product using an apparatus having an elongated tubular member, the elongated tubular member having a first end, a second end and an outer surface, the outer surface of the elongated tubular member providing a surface for forming the pouched flavored tobacco product thereabout; and providing a liquid comprising one or more flavorants to a liquid dispenser system comprising a first fluid dispenser shoe, the first fluid dispenser shoe comprising an inlet for placing in fluid communication with a source of liquid to be dispensed; at least one liquid dispensing manifold in fluid communication with the inlet bore; and a plurality of exit orifices positioned along the at least one liquid dispensing manifold for dispensing the liquid on an outer surface of the pouched product, wherein the first fluid dispenser shoe is positioned downstream of the apparatus and adjacent a stream of pouched products as they exit the apparatus.

Exemplary tobacco materials 20 can be made of cut or ground tobacco and can include additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. Preferably, the tobacco material 20 is pasteurized. In the alternative, the tobacco material 20 may be fermented.

The tobacco material 20 may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used.

Additionally, the tobacco material can also include a supplemental amount of vegetable or plant fibers or particles such as particles or shreds of lettuce, cotton, flax, beet fiber, cellulosic fibers, blends thereof and the like.

Humectants can also be added to the tobacco material 20 to help maintain the moisture levels in the pouched tobacco product. Examples of humectants that can be used with the tobacco material include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier tobacco component.

As shown in FIG. 2, the pouched tobacco product 10 may optionally comprise lined pouched material comprising a web 22 and an optional liner 18. Preferably, the web 22 is constructed from cellulose fiber such as tea bag-type material. Alternative web materials may also be desired for use with the optional liners 18. Alternative web materials preferably have a neutral or pleasant taste or aroma. Preferably, the web material is selected to have desired properties of stain resistance, water permeability and/or porosity, and/or water insolubility. To promote heat-sealability the web may include fibers or coating of polypropylene or other heat-sealable material.

Additionally, the materials used for the web materials can be provided with predetermined levels for basis weight and/or wet strength in order to reduce occurrence of breakage of the web during manufacturing operations, storage and use. For example, webs can be provided with a basis weight of about 5 to about 25 g/m$^2$, such as 5-10, 10-15, 15-20, or 20-25 grams/meters' (g/m$^2$) depending upon the final usage requirements, and/or a wet tensile cross-direction (CD) strength of about 15 to about 75 N/m, such as 15-30, 30-45, 45-60, or 60-75 Newtons/meter (N/m), depending upon the final usage requirements, which can be sufficient for maintaining the webs therein. One exemplary web is a tea bag material with a basis weight of about 16.5 g/m$^2$ with a wet tensile CD strength of 68 N/m.

In one form, a water permeable, water-insoluble, porous, stain-resistant polymer membrane can be used as the web in order to allow flavor to permeate through the web 22.

It is also noted that the thickness of the web 22 can be varied to achieve desired levels of solubility through the web 22. Similarly, the thickness of the optional liner 18 can be varied to achieve desired levels of solubility through the optional liner 18.

Referring again to FIGS. 2 and 5, an optional liner 18 may be provided in a pouched tobacco product 10 in between the tobacco material 20 and the web 22. As used herein the terms "liner" and "liner material" include one or more material sheets, layers or coatings, which can be used to reduce the transfer of moisture from the tobacco component 20 to the web material 22, and/or reduce staining of the web material 22.

In one form, the optional liner 18 is incorporated as a separate sheet, layer or coating on the inside of the web 22 facing the tobacco material 20. As such, the optional liner 18 can be a thin film sheet, layer or coating of only a few microns in thickness or can be a thicker sheet, layer or coating up to about 1 centimeter in thickness.

Preferably, the optional liner 18 is dissolved upon placement of the pouched tobacco product 10 into the mouth although in some forms the optional liner 18 only partially dissolves. Preferably, the pouched tobacco product 10 provides an immediate and continued oral sensorial enjoyment of tobacco by a consumer of the pouched tobacco product 20.

Preferably, the optional liner 18 is not soluble in tobacco additives of the tobacco material 20 so that the additives may be added to the tobacco material without causing the optional liner 18 to be dissolved. By such arrangement the effectiveness of the optional liner 18 against staining of the web is maintained.

The optional liner 18 can also be made semi water-soluble in order to provide a slower rate of dissolution of the optional liner 18 when placed in a mouth, if desired. For example, the optional liner 18 itself can be used to be the carrier of a flavorant or flavor enhancer, wherein the optional liner 18 can provide rapid flavor release (i.e., high water solubility) or a time sustained flavor release (i.e., low water solubility compared to the rapid flavor release liner). The optional liner 18 can also optionally include additional flavor ingredients. Thus, by using an optional liner 18 with predetermined level water solubility, a pouched tobacco product can be provided with rapid or time sustained flavor release and minimum staining of the web.

While the optional liner 18 can be used in an unflavored state, additional flavorant can be incorporated in the optional liner 18, as mentioned above. When a flavorant is incorporated into the optional liner 18, the optional liner 18 can be chosen to provide rapid flavor release (i.e., immediate or a few seconds) or provide a long lasting, time-release flavor (i.e., prolonged up to several minutes and having the property of retarded or gradual dissolution in water to produce a sustained effect), as mentioned above or both.

In order to provide a rapid flavor release, a highly water-soluble optional liner can be used. By employing a highly water-soluble material in a pouched tobacco product 10, saliva can rapidly dissolve the optional liner 18 and rapidly release the flavor therein, thus providing flavor and a mouth feel at lower moisture levels similar to higher moisture content pouched tobacco products. Additionally, other materials can be used to retard the rapid dissolution of the optional liner 18. For example, additives, such as corn zein, can be added to a glucan liner to adjust (i.e., reduce) the water solubility of the glucan and thus retard or slow the dissolution speed of the glucan in water.

While any water-soluble material, such as cellulosic materials, gums, polymers, starches, proteins, and combinations thereof can be used, preferably the optional liner 18 is made of glucans because of their high water solubility, rapid dissolution, and pleasing mouth feel. Examples of suitable glucans include, without limitation, pullulan and elsinan.

Examples of cellulosic materials include, without limitation, carboxymethyl cellulose, methyl cellulose, ethyl cellulose, hydroxymethyl cellulose, hydroxyethyl cellulose, hydroxypropyl cellulose, hydroxypropyLmethyl cellulose, hydroxymethylpropyl cellulose, and combinations thereof.

Examples of water-soluble gums include, without limitation, gum arabic, xanthan gum, tragacanth, acacia, carageenan, guar gum, locust bean gum, pectin, alginates, and combinations thereof.

Examples of other polymers include, without limitation, polyvinyl alcohol, polyacrylic acid, polyvinyl pyrrolidone, poly(meth)acrylate, poly(meth)copolymers, dextrin, dextran, chitin, chitosin, polydextrose, fructose, and combinations thereof.

Examples of starches include, without limitation, tapioca, rice, corn, potato, wheat, and combinations thereof.

Examples of proteins include gelatin, zein, gluten, soy protein, soy protein isolate, whey protein, whey protein isolate, casein, levin, collagen, and combinations thereof.

If a longer flavor release by the optional liner 18 is desired, an optional liner other than the rapidly dissolving optional liners discussed above may be selected. Or in the alternative, a thicker layer of optional liner 18 can be used to extend the length of time for full dissolution of the optional liner and the associated release of flavorants. Or, as another alternative, longer organic chain materials or other agents can be added to the rapidly dissolving optional liners discussed above to lower solubility. Thus, the water solubility of the optional liner 18 can be increased or decreased and can provide control over the moisture content in the tobacco material 20 in the pouched tobacco product 10 by reducing the amount of moisture loss or evaporation from the tobacco material 20 in comparison to a pouched tobacco product without an optional liner.

Alternatively, a multilayered optional liner can be provided between a tobacco material 20 and a web 22. By providing a multilayered optional liner, the functionality of the optional liner can be enhanced compared to that of a single layer optional liner. For example, more than one level of water solubility can be used within the various layers of the multilayered optional liner if desired. The multilayered optional liner can include two, three, four, or more layers depending upon the properties desired from the optional liner.

For example, an optional liner 18 can be provided as two layers, i.e., an outer optional liner and an inner optional liner, between a tobacco material 20 and a web 22. The outer optional liner (adjacent the web 22) can be provided with an immediate initial taste perception (i.e., a high water solubility level), while the inner optional liner (adjacent the tobacco material 20) can be formulated to be moisture resistant (i.e., have a lower water solubility level than the outer optional liner).

The outer optional liner can include highly water-soluble optional liners such that saliva can dissolve the outer optional liner similar to the exemplary single optional liners 18 as mentioned above. As such, examples of the outer optional liner include polysaccharides, such as pectin.

The inner optional liner, on the other hand, can include moisture resistant material that can be both permeable to water and/or air, as well as water-insoluble so that moisture resistance can be maintained even during use. Examples of materials that can be used for the inner optional liner include any porous, water-insoluble webs, sheets or optional liners that can be made of perforated layers or loosely bound fibers or non-woven sheets of waxes, polymers, shellac, corn zein, cellulosic materials, and/or combinations thereof.

Exemplary waxes include carnauba wax, candelilla wax, rice-bran wax, and/or waxes of paraffin and/or polyethylene, wherein wax coatings can provide excellent moisture optional liners.

Exemplary polymers include polyvinyl acetate (PVA), and/or polysaccharides, such as caramelized sugar, which have water-insoluble, or time-release or slowly water soluble properties (i.e., having the property of retarded or gradual dissolution in water to produce a sustained effect).

By using a combination of optional liners, the moisture content of the tobacco material itself can be controlled by the inner optional liner resisting release of the moisture from the tobacco material 20, while flavor can be released from the outer optional liner. Additionally, the inner optional liner can also be dissolvable and flavored, such that a two-stage flavor release can be provided, wherein the outer optional liner can release flavor as a first stage before the inner optional liner dissolves, which in turn releases a second stage of flavor, thus a two-or-more-stage flavor release can be attained if desired.

The optional liner can be disposed along the web by any suitable technique. For example, a strip of optional liner material can be fed along with a strip of web material and the strips can optionally be engaged with each other by pressing the strips together, use of adhesive or tackiness of the optional liner material. Alternatively the optional liner material can be coated on the web. In the case of multiple coatings, each coating, which may be the same or different optional liner, of a multilayered optional liner is preferably dried before application of subsequent coatings. For example, multiple coatings (e.g., 5 coatings) may be applied by gravure printing (see further description, below) to provide a total coating weight effective to achieve non-staining and/or flavor delivery goals such as 10 to 200 mg, 20 to 100 mg, for example, 45 mg/pouched tobacco product. Each coating layer is preferably dried before application of a subsequent coating layer. In order to add flexibility and maintain and protect moisture levels in the pouched tobacco product, one or more humectants, such as, for example, propylene glycol, can be incorporated into the coated web optional liner material.

Preferably, drying of a coated optional liner is performed by gentle drying, for example, air drying at a low temperature (e.g., slightly above ambient, preferably up to about 150° F., more preferably 100-150° F.) and at a lower speed and longer resident time than would be used with higher temperature drying (e.g., 300-350° F.).

In another form, the moisture resistance (i.e., the water solubility) of the optional liner 18 can be adjusted as a function of the moisture content of the tobacco material 20 in order to provide a desired moisture level in the pouched tobacco product 10. For example, the optional liner 18 can include humectants to allow a tobacco material in a pouched tobacco product to maintain a predetermined moisture content of the tobacco between about 5% to about 65%.

In another form, the water activity of the component(s) of the tobacco material 20 can be matched, wherein the water activity represents the ratio of the water vapor pressure of the component to the water vapor pressure of pure water under the same conditions and it is expressed as a fraction. Thus, by matching the water activities of the web material 22, the flavor compounds, and the tobacco material 20, the moisture transfer between the web material 22, flavor compounds, and the tobacco material 20 can be limited. Therefore, by matching or adjusting the water activities, the optional liner 18 can be used to provide flavor release alone, wherein staining of a web can be reduced without requiring further measure.

Exemplary optional liners 18 include food grade materials, such as polysaccharides including pullulan, protein films, or synthetic polymers, including those listed above. It is noted, however, that any optional liner that is biocompatible and reduces staining of the web can be used. Films that can be used for the optional liner include films manufactured by MonoSol, LLC of Portage, Ind. as set forth in International Publication Numbers WO 2004/009445 and WO 2004/052335, hereby incorporated by reference in their entireties.

In order to facilitate coating of the optional liner on the web, the optional liner may be in the form of a slurry. Alternatively or additionally, optional liner material (e.g., slurry of material used to form a optional liner) may be applied to the web during manufacture of the web. Encapsulated flavorants may be incorporated into the optional liner to prolong flavor release from the optional liner.

In one form, the optional liner 18 is coated onto the web 22 prior to assembly of the pouched tobacco product 10 by a suitable coating process, such as, for example, kiss coating, slot coating, spraying or gravure printing. Coating of the optional liner 18 on the web material 22 allows for enhanced control and maintenance of the desired level of translucency of the web. Alternatively, the color of the pouched tobacco product may be controlled by inclusion of appropriate color additives into the optional liner 18 such as whiteners or the like. Thus, through appropriate selection of additives for the optional liner 18, the opaqueness, whiteness, and/or color of the pouched tobacco product may be controlled.

Kiss coating involves applying a coating to a surface using rotating rollers. Fluid flow in a nip between adjacent rollers and the relative speeds of the rollers control the coating thickness. In reverse-roll coating, an applicator roller preferably rotates against a ribbon of web 22 and a slurry of optional liner material is preferably established at the nip between the two rollers.

Slot coating can be used with slurries having a wide range of viscosities. In slot coating, slurry of optional liner material is directed through a slot die to provide a single layer application to a ribbon of the web 22 moving relative to the die. Slurry of optional liner material is fed into the die by a metering device such as, for example, a positive displacement pump. Coating thickness is dependent on speed of the web and flow rate of the slurry.

Gravure printing gives thin, accurate coatings and is capable of high speed application. In gravure printing, a roller with an engraved pattern rotates in a reservoir containing slurry of optional liner material. Slurry of optional liner material is collected in the engraved pattern and excess surface slurry of optional liner material is removed from the roller by a doctor blade. Slurry of optional liner material is transferred from the roller onto the ribbon of web 22.

The optional liner 18 may comprise optional components including, but not limited to, fragrances, coloring agents, filling agents, thickening agents, plasticizers, surfactants, stabilizing agents, antioxidants, preservatives, brighteners and the like.

The optional liner 18 may also include pigments (e.g., coloring agents).

Filling agents may be incorporated in the optional liner 18. Exemplary filling agents include, but are not limited to, cellulose, titanium oxide, magnesium silicate (e.g., talc), aluminum silicate, magnesium carbonate, calcium carbonate (e.g., limestone), calcium phosphate, calcium sulfate, zinc oxide, aluminum oxide, and mixtures thereof. Other carbonate and phosphate salts can be added.

Starches and/or cellulose ethers can also be incorporated in the optional liner 18, wherein the starches and/or cellulose ethers can act as thickening agents or binding agents. Additionally, polymers, such as polyvinyl pyrrolidone and polyvinyl alcohol, and gums, such as xanthan gum, gum Arabic and acacia gum, can be used as thickening agents. Generally, the stiffness of an optional liner 18 can be increased and the dissolution rate (i.e., dissolution upon exposure to moisture) can be decreased by increasing the average molecular weight of polymers that form the optional liner 18. Thus, by adding thickening agents the modulus (i.e., stiffness) of the optional liner 18 can be increased, while the propensity toward curling or bending of an optional liner 18 during or after drying (e.g., during storage) can be decreased.

Plasticizing agents can also be used to control the stiffness of the optional liner 18, as well as the viscosity of the polymer melt from which an optional liner 18 is formed. Exemplary plasticizing agents include monoacetin; diacetin; triacetin; glycols, such as polyethylene glycol and propylene glycol; polyhydric alcohols, such as glycerin and sorbitol; mineral oils; vegetable oils; and glycerol and glycerol esters, such as glycerol triacetate.

Surfactants can also be incorporated in the optional liner 18. Suitable surfactants include, but are not limited to, mono and diglycerides of fatty acids, lactylates, pluronic acid, polyoxyethylene sorbitol esters, latanol, and sodium lauryl sulfate.

Stabilizing agents can also be incorporated in the optional liner 18. Exemplary stabilizing agents are gums, such as guar gum, xanthan gum, locust bean gum, and carrageenan.

Exemplary optional liners 18 can also optionally comprise antioxidants and/or preservatives. Exemplary antioxidants include, but are not limited to, ascorbic acid, vitamin E and sodium pyrosulfate. Exemplary preservatives include, but are not limited to, acetic acid, benzoic acid, citric acid, lactic acid, malic acid, sorbic acid and tartaric acid.

The optional liners 18 can be translucent or substantially opaque.

Sealing may be accomplished by any suitable sealing method, such as, for example, adhesive or by mutual sealing. Mutual sealing may be thermal or sonic. Preferably, sealing is accomplished by thermal sealing, as indicated above. In particular, the thermal sealing may be accomplished using an arcuate iron (heater), such as a heated disc. An arcuate iron would engage one side of the web, which preferably contains polypropylene, for example, in the form of polypropylene fibers or a polypropylene film, and press the first side of the web against the second side of the web, and against a second, opposed iron or non-heated surface.

While the present inventions have been described in connection with a number of exemplary forms, and implementations, the present inventions are not so limited, but rather cover various modifications, and equivalent arrangements, which fall within the purview of the present claims.

What is claimed:

1. A system for producing pouched tobacco products comprising:

an apparatus for forming and filling pouched products; and a liquid dispenser system including a first fluid dispenser shoe, said first fluid dispenser shoe comprising:

(a) an inlet bore for placing in fluid communication with a source of liquid to be dispensed;

(b) at least one liquid dispensing manifold in fluid communication with said inlet bore; and (c) a plurality of exit orifices each having a diameter of about 0.2 mm, positioned along said at least one liquid dispensing manifold for dispensing the liquid by capillary or wicking action on an outer surface of the pouched product, wherein said first fluid dispenser shoe is positioned downstream of the apparatus for forming and filling pouched products and adjacent a stream of pouched products as they exit the apparatus.

2. The system of claim 1, wherein said first fluid dispenser shoe comprises a block for forming said at least one liquid dispensing manifold within.

3. The system of claim 2, wherein said block of said first fluid dispenser shoe is rectangularly configured.

4. The system of claim 3, wherein said at least one liquid dispensing manifold is formed within said block so as to be substantially perpendicular to the stream of pouched products exiting the apparatus.

5. The system of claim 4, further comprising a second fluid dispenser shoe, said second fluid dispenser shoe positioned substantially parallel to said first fluid dispenser shoe and spaced apart therefrom so as to permit the stream of pouched products to pass therebetween and receive the dispensed liquid on at least two sides thereof.

6. The system of claim 5, further comprising a plurality of liquid dispensing manifolds each aligned substantially parallel with respect to one another.

7. The system of claim 6, wherein each liquid dispensing manifold includes at least four exit orifices.

8. The system of claim 6, wherein each liquid dispensing manifold includes at least six exit orifices.

9. The system of claim 6, wherein each liquid dispensing manifold includes at least eight exit orifices.

10. The system of claim 9, further comprising a bracket member for mounting said first and second fluid dispenser shoe, said second fluid dispenser shoe positioned substantially parallel to said first fluid dispenser shoe and spaced apart therefrom so as to permit the stream of pouched products to pass therebetween and receive the dispensed liquid on at least two sides thereof.

11. A system for making a pouched product, the system comprising:

(a) means for supplying a web material for forming a pouch;

(b) an apparatus for forming and filling the pouched product, the apparatus including an elongated tubular member, said elongated tubular member having a first end, a second end and an outer surface, said outer surface of said elongated tubular member providing a surface for forming the pouched product from the supply of web material;

(c) a forming shoulder, said forming shoulder receiving the web from said supply of web material and folding the web about said apparatus to form the pouch having longitudinal edge portions;

(d) a heated knurled disc for sealing the longitudinal edge portions of the web to form a seam as the web is drawn along said apparatus;

(e) a liquid dispenser system comprising a first fluid dispenser shoe, said first fluid dispenser shoe comprising (i) an inlet bore for placing in fluid communication with a source of liquid to be dispensed;

(ii) at least one liquid dispensing manifold in fluid communication with said inlet bore; and (iii) a plurality of exit orifices each having a diameter of about 0.2 mm, positioned along said at least one liquid dispensing manifold for dispensing the liquid by capillary or wicking action on an outer surface of the pouched product, wherein said first fluid dispenser shoe is positioned downstream of the apparatus for forming and filling pouched products and adjacent a stream of pouched products as they exit the apparatus.

12. The system of claim 11, further comprising drive belts or drive wheels located below said forming shoulder to continuously pull the web through said forming shoulder.

13. The system of claim 12, further comprising an upper pair of opposing heat-sealing elements and a lower pair of heat-sealing elements to cooperate with a knife to repetitively seal and sever pouched product.

14. The system of claim 13, wherein discrete charges of tobacco are fed through said elongated inner tubular member of said apparatus in timing with the operation of said heat-sealing elements.

15. The system of claim 14, wherein said heat-sealing elements and knife follow a motion cycle wherein said heat-sealing elements close together and tobacco is fed into said elongated inner tubular member of said apparatus.

16. The system of claim 15, wherein metered portions of tobacco are blown via air into said elongated tubular member of said apparatus after the upper heat-sealing elements are closed.

17. The system of claim 16, wherein a liquid comprising one or more flavorants is fed to said liquid dispenser system thereby providing at least a partial coating of the one or more flavorants.

18. The system of claim 11, wherein said first fluid dispenser shoe comprises a block for forming said at least one liquid dispensing manifold within.

19. The system of claim 18, wherein said block of said first fluid dispenser shoe includes a track member, and wherein the exit orifices are located within the track member.

20. The system of claim 19, further comprising a second fluid dispenser shoe including a track member with exit orifices located therein, said second fluid dispenser shoe positioned substantially parallel to said first fluid dispenser shoe and spaced apart therefrom so as to form a channel defined by said track members to permit the stream of pouched products to pass therethrough and receive the dispensed liquid on at least two sides thereof.

21. The system of claim 20, further comprising a plurality of liquid dispensing manifolds each aligned substantially parallel to one another.

22. The system of claim 21, wherein each liquid dispensing manifold includes at least four exit orifices.

23. The system of claim 21, wherein each liquid dispensing manifold includes at least six exit orifices.

24. The system of claim 21, wherein each liquid dispensing manifold includes at least eight exit orifices.

25. The system of claim 24, further comprising a bracket member for mounting said first and second fluid dispenser shoe, said second fluid dispenser shoe positioned substantially parallel to said first fluid dispenser shoe and spaced apart therefrom so as to permit the stream of pouched products to pass therebetween and receive the dispensed liquid on at least two sides thereof.

26. A method of forming a pouched flavored product, comprising:

(a) providing a web for use in forming the pouched flavored product;

(b) forming and filling a pouched flavored product using an apparatus having an elongated tubular member, the elongated tubular member having a first end, a second end and an outer surface, the outer surface of the elongated tubular member providing a surface for forming the pouched flavored product thereabout; and (c) providing a liquid comprising one or more flavorants to a liquid dispenser system comprising a first fluid dispenser shoe, the first fluid dispenser shoe comprising (i) an inlet bore for placing in fluid communication with a source of liquid to be dispensed;

(ii) at least one liquid dispensing manifold in fluid communication with the inlet bore; and (iii) a plurality of exit orifices each having a diameter of about 0.2 mm, positioned along the at least one liquid dispensing manifold for dispensing the liquid by capillary or wicking action on an outer surface of the pouched product, wherein the first fluid dispenser shoe is positioned downstream of the apparatus and adjacent a stream of pouched products as they exit the apparatus.

27. The method according to claim 26, wherein the liquid dispenser system further comprises a second fluid dispenser shoe, the second fluid dispenser shoe positioned substantially parallel to the first fluid dispenser shoe and spaced apart therefrom so as to permit the stream of pouched products to pass therebetween and receive the dispensed liquid on at least two sides thereof.

28. The method according to claim 27, further comprising the step of sealing overlapping portions of the web.

29. The method according to claim 28, further comprising the step of severing the pouched flavored product from the web.

30. The method according to claim 29, wherein the at least one liquid dispensing manifold includes at least eight exit orifices.

31. A system for making a pouched product, the system comprising:

(a) means for supplying a web material for forming a pouch;

(b) an apparatus for forming and filling the pouched product, the apparatus including an elongated tubular member, said elongated tubular member having a first end, a second end and an outer surface, said outer surface of said elongated tubular member providing a surface for forming the pouched product from the supply of web material;

(c) a forming shoulder, said forming shoulder receiving the web from said supply of web material and folding the web about said apparatus to form the pouch having longitudinal edge portions;

(d) a heated knurled disc for sealing the longitudinal edge portions of the web to form a seam as the web is drawn along said apparatus;

(e) a liquid dispenser system comprising a first fluid dispenser shoe, said first fluid dispenser shoe comprising (i) an inlet bore for placing in fluid communication with a source of liquid to be dispensed;

(ii) at least one liquid dispensing manifold in fluid communication with said inlet bore; and (iii) a plurality of exit orifices positioned along said at least one liquid dispensing manifold for dispensing the liquid on an outer surface of the pouched product, wherein said first fluid dispenser shoe is positioned downstream of the apparatus for forming and filling pouched products and adjacent a stream of pouched products as they exit the apparatus, said first fluid dispenser shoe comprises a block for forming said at least one liquid dispensing manifold within, said block of said first fluid dispenser shoe includes a track member, and the exit orifices are located within the track member.

* * * * *